US007845525B2

(12) United States Patent
Lantz et al.

(10) Patent No.: US 7,845,525 B2
(45) Date of Patent: Dec. 7, 2010

(54) CARBONATED DRINK CLOSURE AND DISPENSING DEVICE

(75) Inventors: Daniel J. Lantz, Orlando, FL (US); Keen Wong, Knoxville, TN (US)

(73) Assignee: Dart Industries Inc., Orlando, FL (US)

( * ) Notice: Subject to any disclaimer, the term of this patent is extended or adjusted under 35 U.S.C. 154(b) by 478 days.

(21) Appl. No.: 11/727,199

(22) Filed: Mar. 23, 2007

(65) Prior Publication Data

US 2008/0230506 A1 Sep. 25, 2008

(51) Int. Cl.
*B67D 3/00* (2006.01)

(52) U.S. Cl. ..... 222/507; 222/461; 222/509; 222/520; 222/548; 222/552; 220/254.8; 215/313

(58) Field of Classification Search ..... 222/461, 222/505, 506, 507, 509, 519, 520, 521, 548, 222/549, 552; 220/254.8, 714; 215/313
See application file for complete search history.

(56) References Cited

U.S. PATENT DOCUMENTS

| | | | | |
|---|---|---|---|---|
| 5,938,086 | A * | 8/1999 | Gross | 222/507 |
| 5,947,331 | A | 9/1999 | Goncalves | |
| 6,443,336 | B2 * | 9/2002 | Antonetti et al. | 222/509 |
| 6,550,640 | B2 * | 4/2003 | Smith | 222/1 |
| 6,571,994 | B1 * | 6/2003 | Adams et al. | 222/521 |
| 6,662,978 | B2 * | 12/2003 | Lin et al. | 222/509 |
| 7,073,678 | B1 * | 7/2006 | Dibdin et al. | 222/548 |
| 2004/0040962 | A1 * | 3/2004 | Bielecki et al. | 220/254.8 |
| 2005/0236440 | A1 * | 10/2005 | Cho | 222/519 |
| 2006/0180585 | A1 | 8/2006 | Cunningham et al. | |
| 2006/0196894 | A1 | 9/2006 | Lindsay | |

FOREIGN PATENT DOCUMENTS

| | | |
|---|---|---|
| DE | 2152725 | 4/1973 |
| EP | 1 145 674 | 10/2007 |
| WO | WO 2005/097614 | 10/2005 |

* cited by examiner

*Primary Examiner*—Kevin P Shaver
*Assistant Examiner*—Jonathan Wood

(57) ABSTRACT

A carbonated drink closure and dispensing device having an upper cap portion, a lower cap portion removably and rotatably secured to the upper cap portion at one end, and removably secured to a top opening of a container at an opposing end. The lower cap portion includes an opening allowing fluid contents of the container to flow thererough, and a valve member is dimensioned and configured to cover the lower cap portion opening. An anti-rotation device is disposed on the lower cap portion and houses the valve member, wherein the rotation of the upper cap portion slides the valve member within the anti-rotation device, closing off the opening of the lower cap portion in one position, and moves away from the opening of the lower cap portion allowing fluid contents from the container to flow through the opening and through the upper cap portion.

10 Claims, 7 Drawing Sheets

CARBONATED DRINK CLOSURE AND DISPENSING DEVICE

TECHNICAL FIELD

The present invention is directed toward a container closure, and more particularly, toward a self-sealing and dispensing closure for a carbonated drink container.

BACKGROUND OF THE INVENTION

Prior art dispensing closures have been commonly used for widespread applications on containers for water, fruit juices, sports drinks, and hot beverages such as coffee. Commonly, such closures include a manually operable valve which permits the contents of the container to be dispensed through an aperture or spout as desired.

However, one of the shortcomings of the prior art closures is that they cannot be effectively used for carbonated drinks, which would require keeping the contents of the container in carbonated form and preventing the contents from going flat.

It is therefore a primary object of the present invention to provide a container closure which would keep the carbonated contents of the container in a carbonated and sparkling form preventing it to become flat.

It is a further object of the present invention to provide a carbonated container closure which would allow the user to use the closure and container in any holding orientation to consume the contents.

SUMMARY OF THE INVENTION

These problems and others are addressed by the present invention which comprises a carbonated drink closure and dispensing device disclosed having an upper cap portion, a lower cap portion removably and rotatably secured to the upper cap portion at one end, and removably secured to a top opening of a container at an opposing end. The lower cap portion includes an opening allowing fluid contents of the container to flow thererough, and a valve member is dimensioned and configured to cover the lower cap portion opening. The valve member threadably engages the upper cap portion, and an anti-rotation device is disposed on the lower cap portion and houses the valve member, wherein the rotation of the upper cap portion slides the valve member within the anti-rotation device to close off the opening of the lower cap portion in one position, and moves away from the opening of the lower cap portion allowing fluid contents from the container to flow through the opening and through the upper cap portion.

BRIEF DESCRIPTION OF DRAWINGS

These and other objects of the present invention will be appreciated and understood by those skilled in the art from the detailed description of the preferred embodiments of the invention and the following drawings of which.

DETAILED DESCRIPTION OF THE INVENTION

Figure 1:
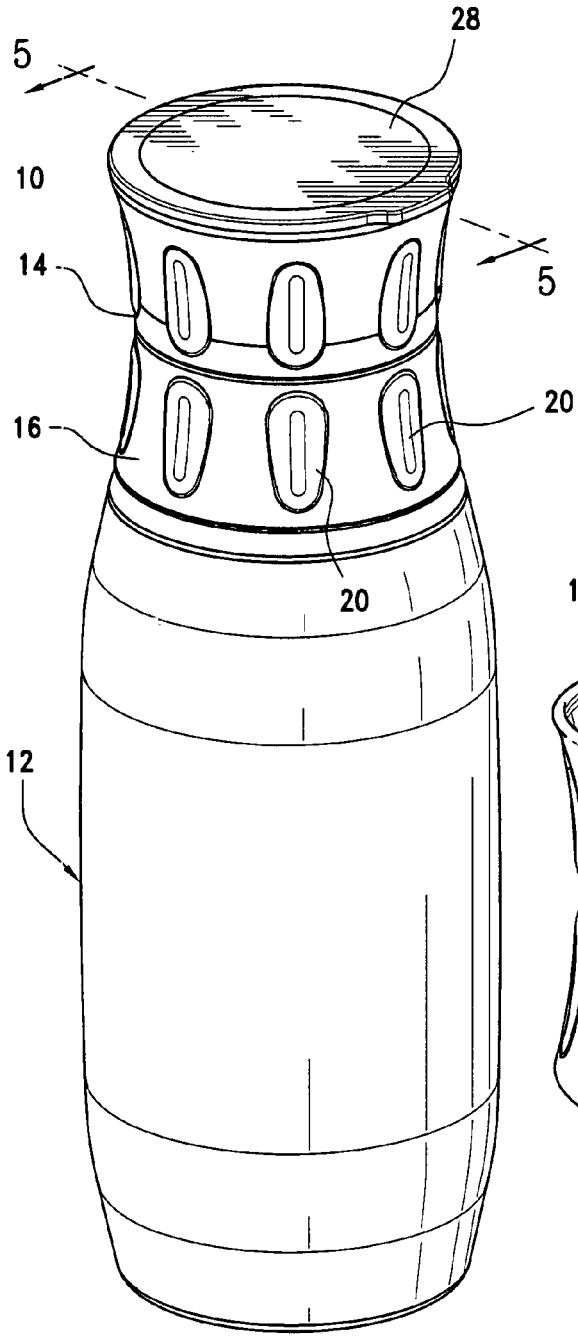
FIG. 1 is a perspective view of the carbonated drink closure and dispensing device and container assembly according the present invention.
Figure 2:
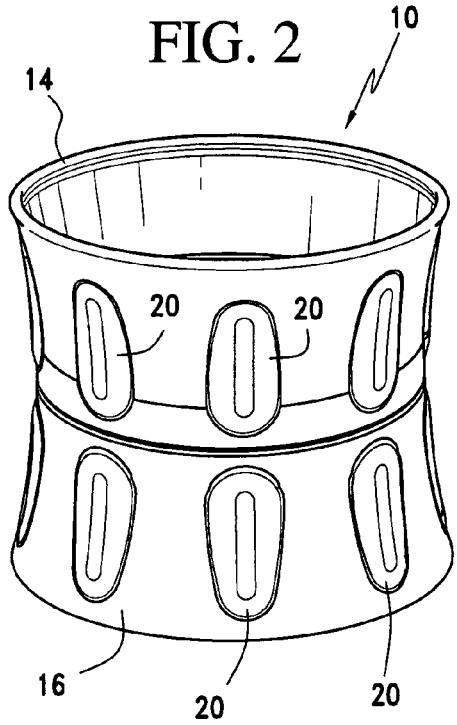
FIG. 2 is a perspective view of the carbonated drink closure and dispensing device according to FIG. 1.
Figure 3:
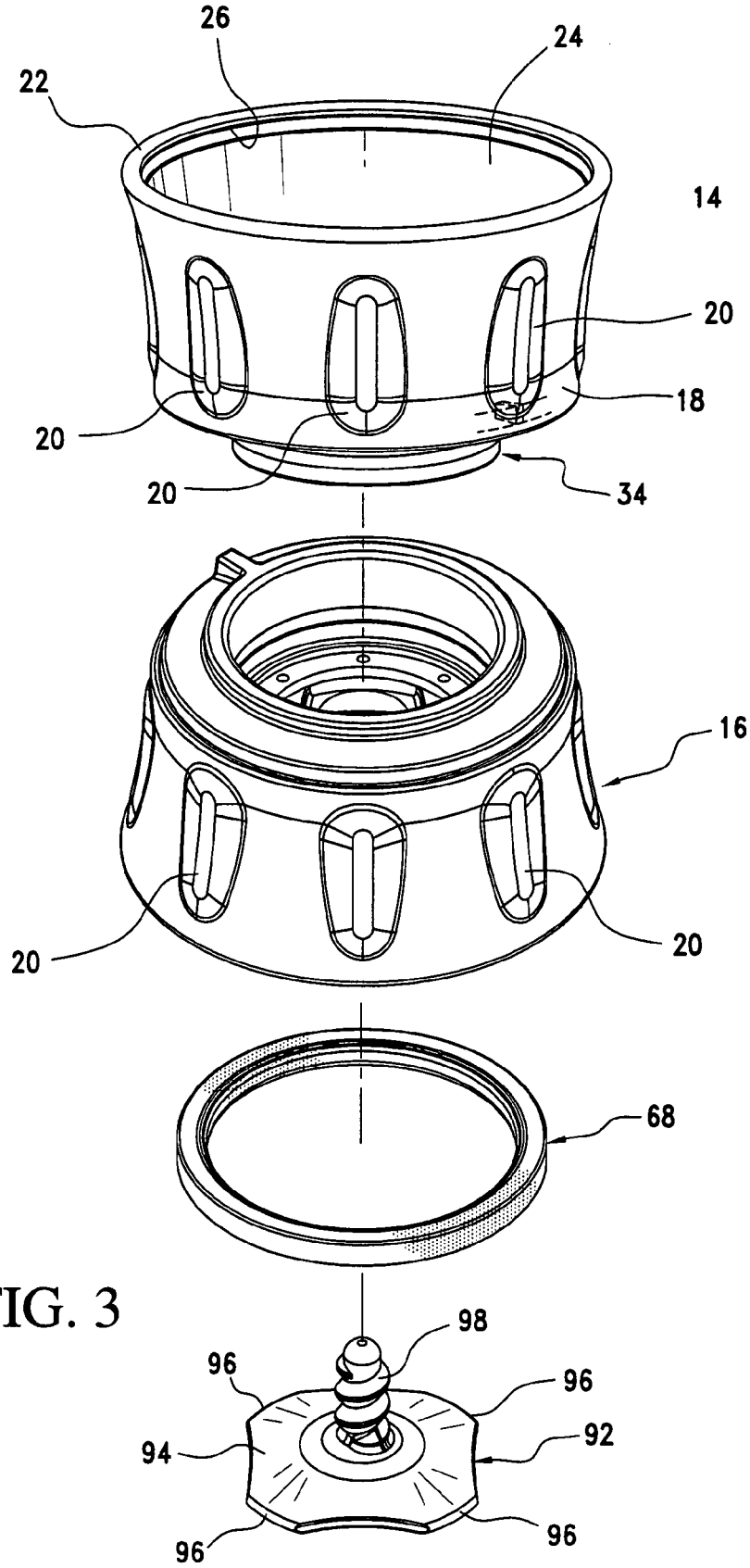
FIG. 3 is an exploded perspective view of the carbonated drink closure and dispensing device.
Figure 4:
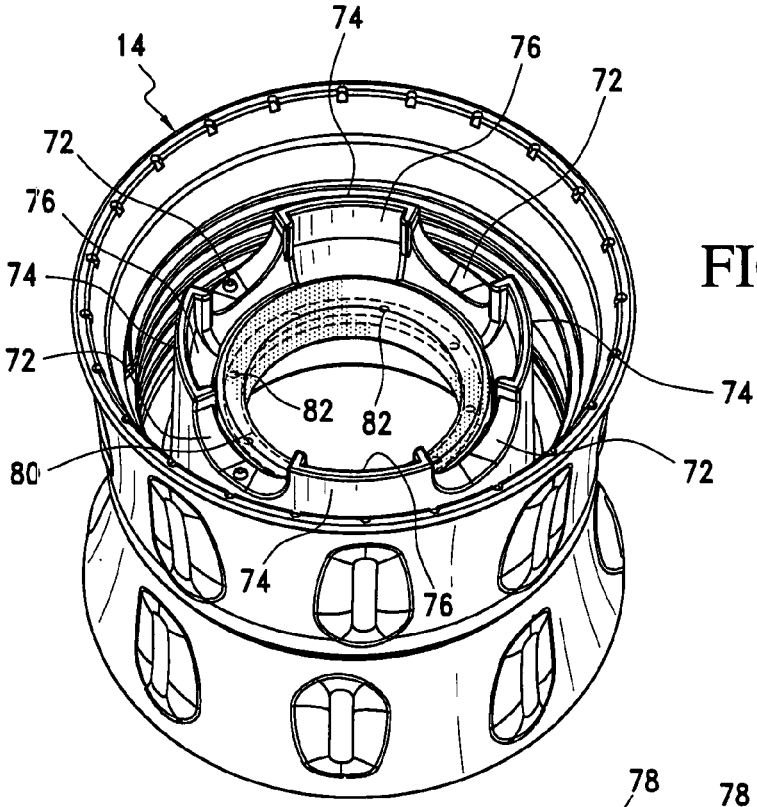
FIG. 4 is a bottom perspective view of the carbonated drink closure and dispensing device of FIG. 1 without the valve assembly.
Figure 5:
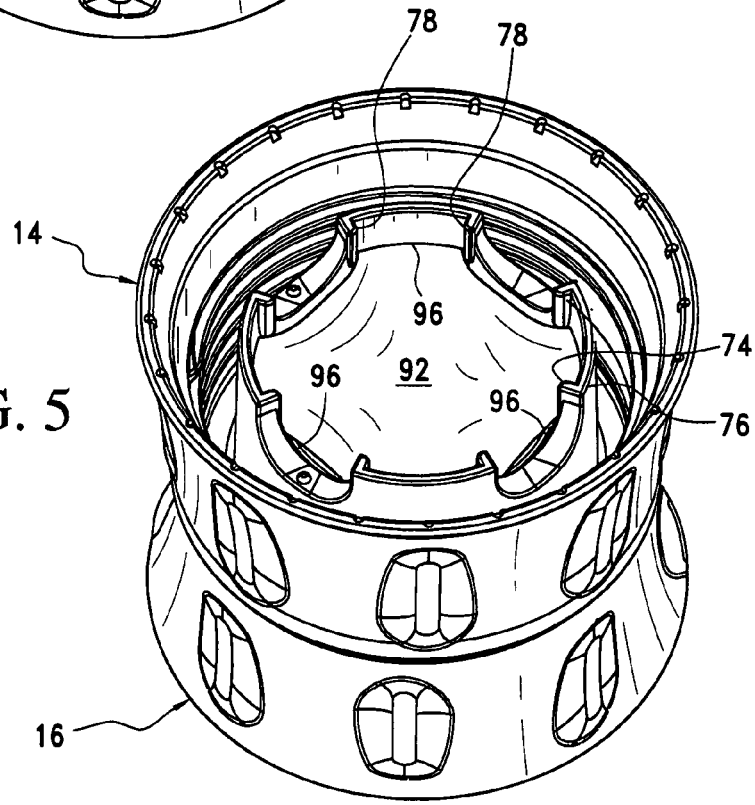
FIG. 5 is a bottom perspective view of the carbonated drink closure and dispensing device of FIG. 3 with a valve assembly in a closed position.

Referring now to the drawings, and more specifically FIG. 1, wherein the showings are for the purpose of illustrating the preferred embodiment of the invention only and not for the purpose of limiting the same, a carbonated drink closure and dispensing device 10 is removably disposed on a reusable carbonated drink bottle or container 12.

The closure and dispensing device 10 includes an upper cap portion generally illustrated at 14, and a lower cap portion generally illustrated at 16, wherein, as will be explained in greater detail herein, the upper cap portion 14 removably and rotatably engages on top of the lower cap portion 16.

The upper cap portion 14 has a substantially cylindrical shape and configuration including an outer wall 18 with a slightly inwardly arcuate shape creating a slightly larger upper section diameter than that of the lower section diameter. A plurality of oval-shaped protrusions 20 are disposed on the outer surface of the outer wall 18 in a symmetrical manner, wherein the oval-shaped protrusions 20 provide a means for a user's grip to be able to rotate the upper cap portion 14.

The upper cap portion 14 includes an upper peripheral rim 22 bounding an opening 24 for sipping the contents of the container, and a peripheral recess 26 for removably securing a lid 28. The lid 28 includes a downwardly extending circular extension 30 which includes an outwardly extending bead portion 32. The outwardly extending bead portion 32 is received within a peripheral recess 26 adjacent the upper periphery of upper cap portion 14 to removably secure the lid 28 to the upper cap portion 14.

Figure 6:
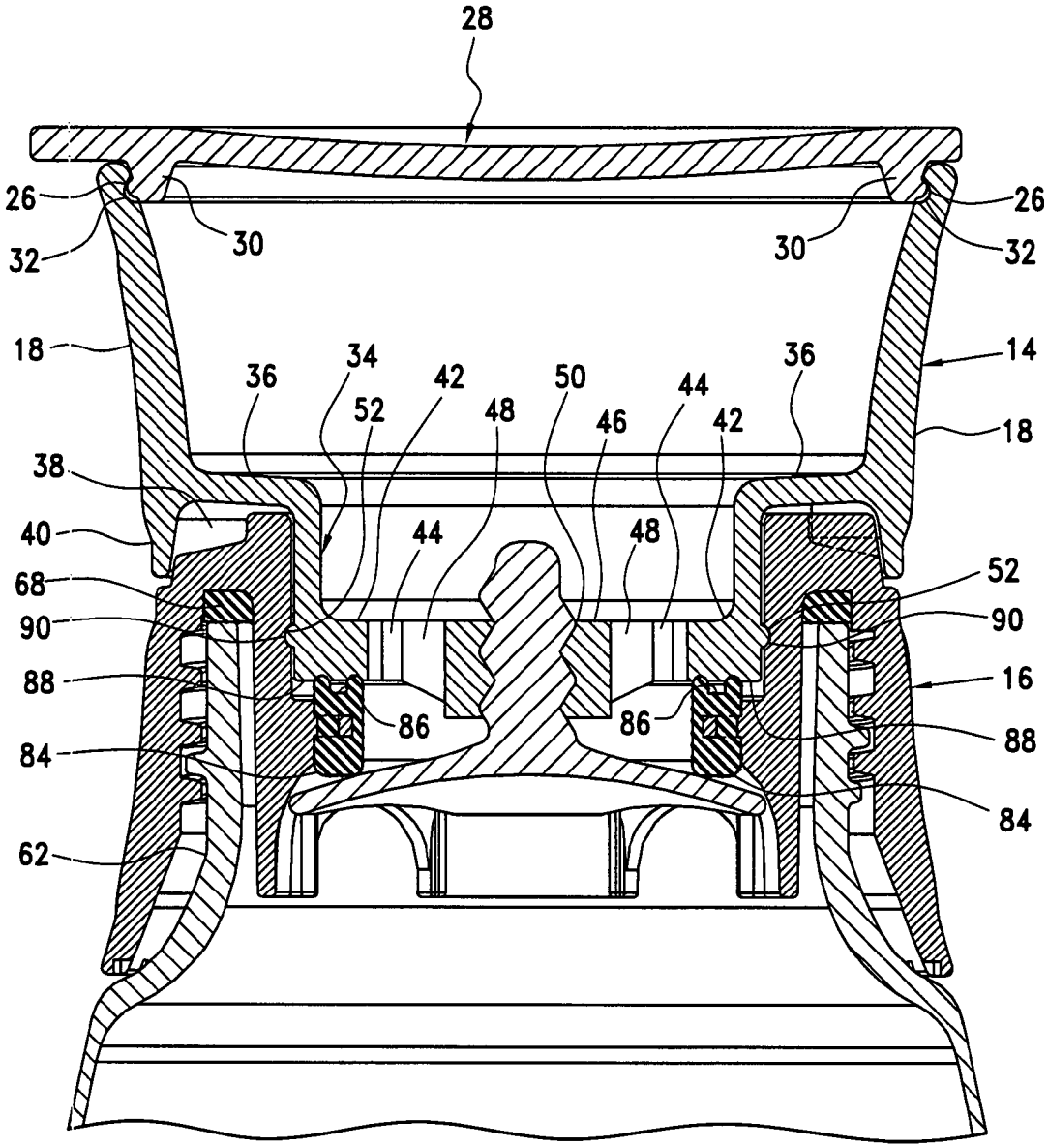
FIG. 6 is a side sectional view of the carbonated drink closure and dispensing device of FIG. 1 with the valve in a closed position.
Figure 7:
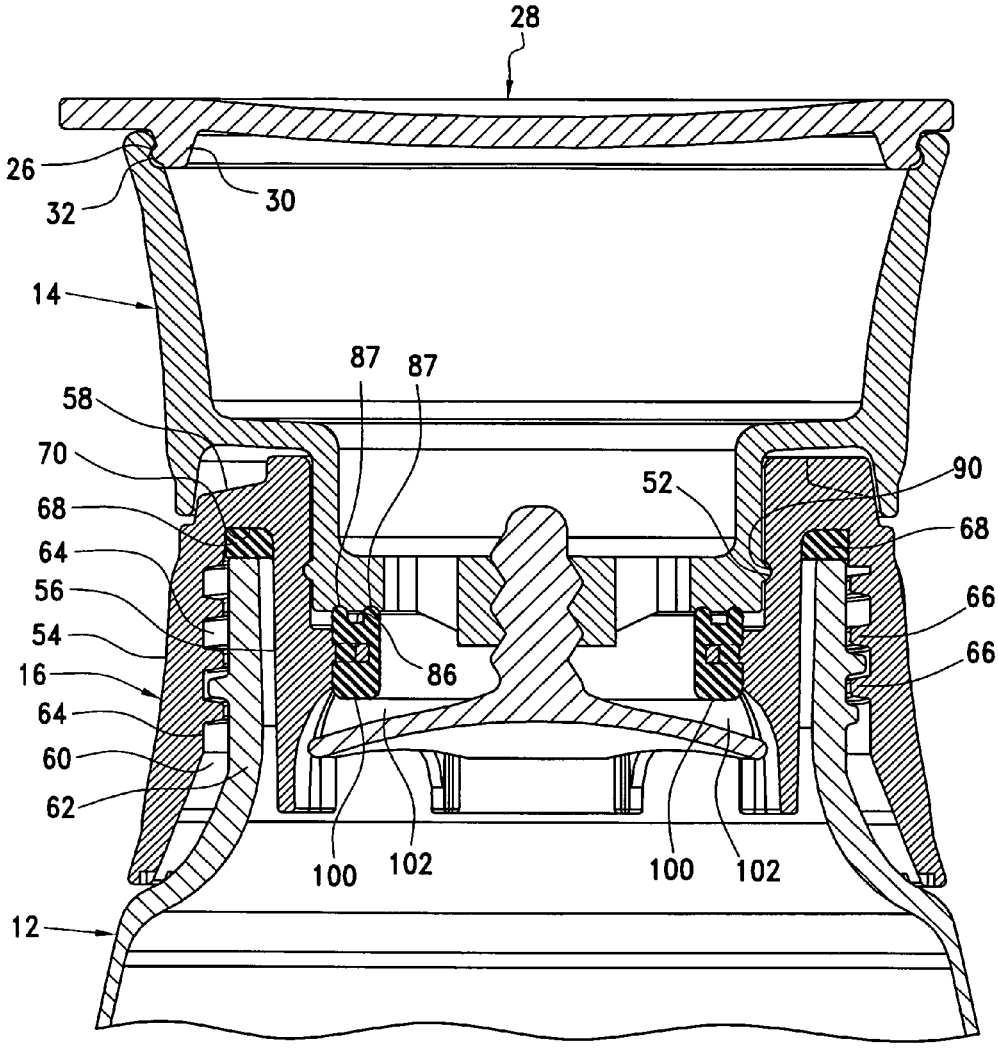
FIG. 7 is a side sectional view of the carbonated drink closure and dispensing device of FIG. 1 with the valve in a open position.

Referring now to FIGS. 6 and 7, the upper cap portion 14 includes a sunken cylindrical section 34 having a smaller diameter than that of the upper cap portion 14, wherein the sunken cylindrical section 34 extends beyond a bottom wall 36 of the upper cap portion 14. An annular recess 38 is created between a downwardly extending outer wall extension 40, the bottom wall 36, and the sunken cylindrical section 34, wherein, as will be explained herein in greater detail, the annular recess 38 receives a portion of the lower cap portion 16.

The sunken cylindrical portion 34 includes a bottom wall 42 housing a plurality of apertures or openings 44 of any desired shape and configuration allowing for the flow of the fluid content. The plurality of openings 44 allows the user to sip and drink the content by holding the carbonated drink container 12 in any orientation in his or her hand.

A central cylindrical post 46 is centrally supported by a plurality of support pieces 48, and includes a threaded bore 50 for threadably engaging a valve member. A circumferential bead 52 is disposed around the outer circumference of the sunken cylindrical portion 34 for a snap fit securing of the upper cap portion 14 with the lower cap portion 16.

The lower cap portion 16 is symmetrically shaped and configured the same as the upper cap portion 14 and includes a plurality of oval-shaped protrusions 20 on an outer surface thereof. The lower cap portion 16 includes an outer wall 54, an inner wall 56, and a top wall 58 connecting the outer wall 54 and the inner wall 56 and bounding an annular space 60 therebetween for receiving an upper portion 62 of the bottle 12.

The upper portion 62 of the bottle 12 includes a plurality of threads 64 on its outer surface, which threadably engages a plurality of threads 66 on an inner surface of the outer wall 54 of the lower cap portion 16. As the lower cap portion 16 is secured on the bottle 12, a substantially resilient O-ring 68 is placed in between the top peripheral rim of the bottle 12 and the lower surface 70 of the top wall 58, creating a seal between the lower cap portion 16 and the bottle 12 preventing the contents of the bottle 12 from leaking in between the contact point of the lower cap portion 16 and the bottle 12.

The inner wall 56 includes a plurality of cut-out sections 72, preferably, but not limited to, four cut-out sections, thereby creating a plurality of, preferably, but not limited to, four arcuate posts 74 each having a channel-type recess 76 with a pair of protruding side walls 78, which, as will be explained, receive and prevent the rotation of a valve member.

The inner wall 56 includes a circular extension 80 with a plurality of apertures 82 extending from a top surface to a bottom surface thereof, wherein a second seal member 84 is disposed therearound by a two component injection molding process on the edge of the circular extension 80, wherein the resilient material is injection molded through the apertures 83 thereby permanently creating and securing the second seal member 84 on the circular extension 80. The second seal member 84 includes a circular recess 86 created by a pair upwardly extending rim portion 87 on a top surface thereof, where in assembled configuration of the closure and dispensing device 10, the second seal member 84 creates a sealing contact with the lower surface 88 of the bottom wall 42.

The upper cap portion 14 and the lower cap portion 14 are snap fit secured together by the circumferential bead 52 engaging the circumferential bead-receiving recess 90 on the outer surface of the inner wall 56 of the lower cap portion 16.

Referring now to FIGS. 6 and 7, a valve member 92 is explained. The valve member 92 includes a convex sealing portion 94 having a substantially square shape and configuration with four straight and flattened corners 96 shaped and configured to be received within each corresponding channel-type recess 76 of each post 74.

The valve member 92 further includes a threaded screw portion 98 extending perpendicular and upwardly from the upper and central portion of the convex sealing portion 94, and is preferably made integral with the convex sealing portion 94. The threads on the threaded screw portion 98 are dimensioned to engage the threads inside the threaded bore 50 of the central cylindrical post 46.

Once the upper cap portion 14 is snap fit secured to the lower cap portion 16, it can freely rotate relative to the lower cap 16 portion without being vertically displaced by the virtue of the circumferential bead 52 and bead receiving recess 90, as the lower cap portion 16 is sealingly secured to the bottle 12. Therefore, once the valve member 92 is in place and the threaded screw portion 98 engages the threads of the threaded bore 50, the rotation of the upper cap portion 14 results in the rotation of the integral central cylindrical post 46, wherein the threaded engagement of the threaded screw portion 98 results in the valve member 92 moving up and down while the rotation of the valve member 92 is prevented by the four flattened corner 96 engaging a corresponding channel type recess 76 of each post 74.

The upper cap portion 14 can rotate one full revolution or three hundred sixty degrees from a first position in one direction to a second position, and then fully rotate back to the first position, where in the first position the valve member 92 is in a fully open position, as illustrated in FIG. 7, and where in the second position the valve member 92 is in a fully closed position, as illustrated in FIG. 6.

The fully closed position of the valve member 92 results from the upper surface of the convex sealing portion 94 coming into contact with the lower surface 100 of the second seal member 84 preventing any liquid flow, and the fully open position results from the upper surface of the convex sealing portion 94 moving away from the lower surface 100 of the second seal member 84, wherein a gap 102 is created therebetween allowing for the fluid content of the carbonated drink bottle to flow in and through the plurality of apertures or openings.

It is noted that in a fully closed and sealed position of the valve member 92, the sealing of the container is achieved by three seal actions: the O-ring type seal 68 between the upper peripheral surface of the bottle and the lower surface of the top wall, the upper surface of the recessed portion of the second seal member and the lower surface of the bottom wall 42, and the upper surface of the convex sealing portion 94 and the lower surface of the second seal member 84.

Figure 8:
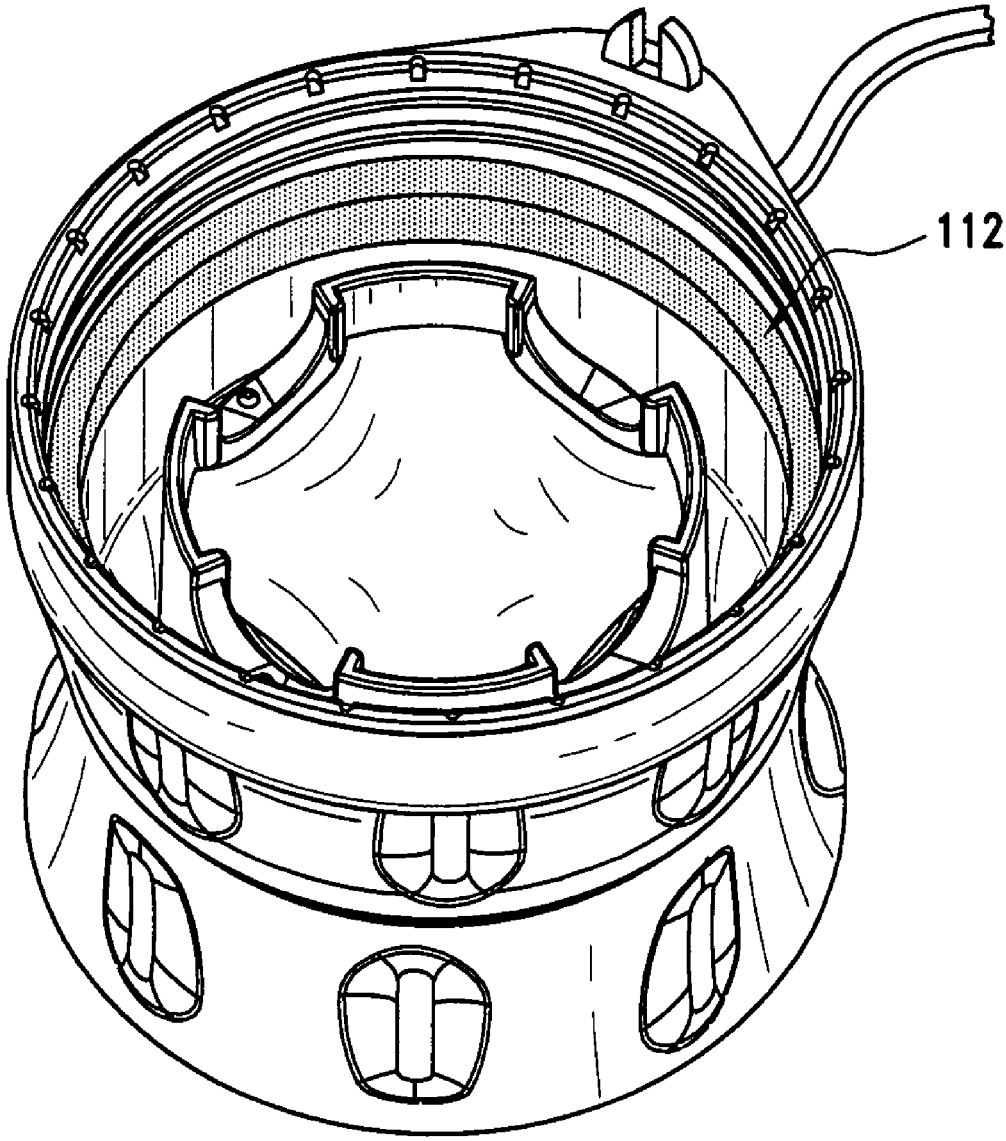
FIG. 8 is a is a bottom perspective view of the carbonated drink closure and dispensing device in accordance with a second representative embodiment with a valve assembly in a closed position; and, FIG. 9 is a side sectional view of the carbonated drink closure and dispensing device of FIG. 8 with the valve in a closed position.
Figure 9:
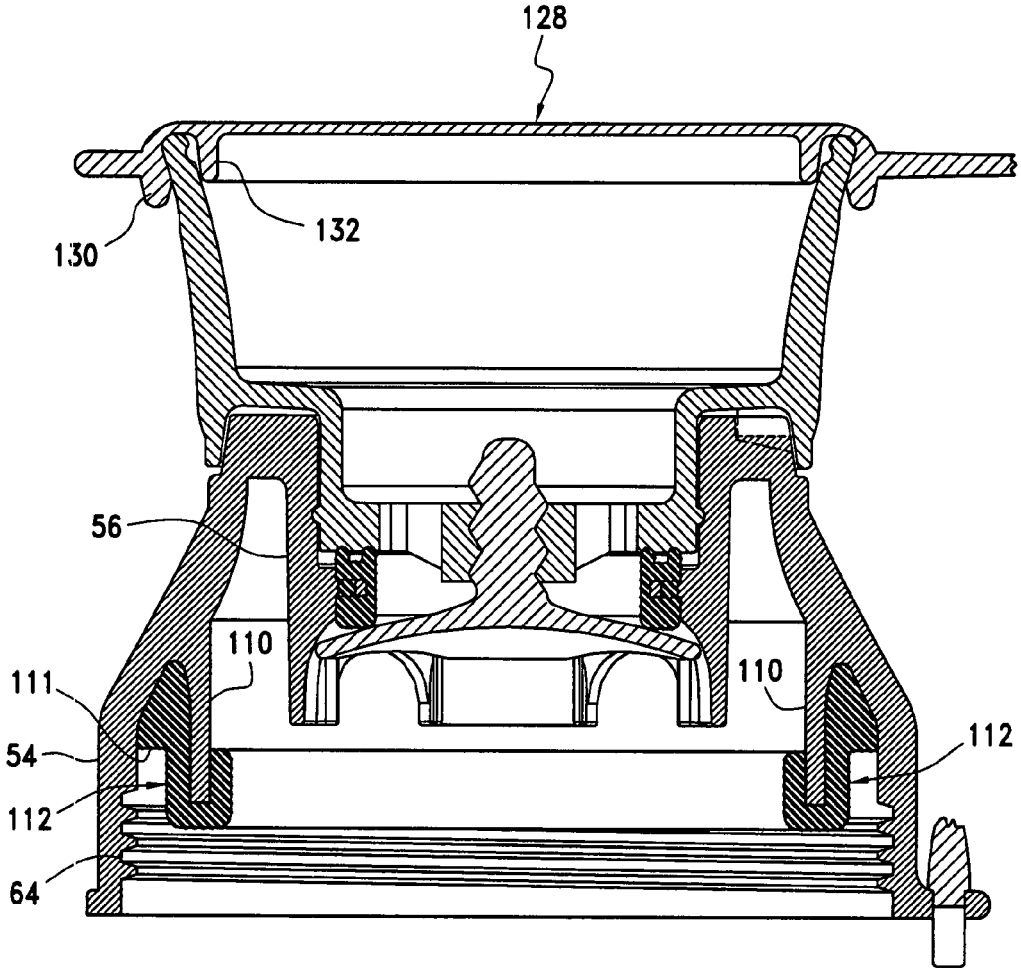

Referring now to FIGS. 8 and 9, a second representative embodiment of the carbonated drink closure and dispensing device is illustrated. The second embodiment contemplates a slightly different securing means for threadably and removably securing the closure on top of the bottle. More specifically, the plurality of threads 66 on the inner surface of the outer wall 54 of the lower cap portion 16 is extended further down, and a circular auxiliary wall 110 integrally extends from an inner surface of the outer wall 54 so that an annular space 111 is created between the inner surface of the circular auxiliary wall 110 and the inner surface of the outer wall 54.

The substantially resilient O-ring 68 between the top peripheral rim of the bottle 12 and the lower surface 70 of the top wall 58 in the first embodiment is now replaced with a substantially hook-shaped resilient seal 112, a portion of which is positioned within the annular space 111 creating a seal on the top peripheral rim of the bottle 12, and a second portion of which is secured by a lower end of the circular auxiliary wall 110 thereby creating a seal between the lower cap portion 16 and the bottle 12 preventing the contents of the bottle 12 from leaking in between the contact point of the lower cap portion 16 and the bottle 12.

The second embodiment of the closure further includes a lid 128 having a downwardly extending circular first extension 132 and a downwardly extending circular second extension 130 creating an annular space therebetween for receiving the upper periphery of upper cap portion 14 to removably secure the lid 128 to the upper cap portion 14.

While preferred embodiments of the invention have been shown and described, various modifications and substitutions may be made thereto without departing from the spirit and scope of the invention. Accordingly, it is to be understood that the present invention has been described by way of illustration only, and this description should not be construed as limiting to the several claims appended hereto.

What is claimed is:

1. A carbonated drink closure and dispensing device for a container, said device comprising:

an upper cap portion;

a lower cap portion removably and rotatably secured to said upper cap portion at one end;

said lower cap portion having an opening allowing fluid contents of the container to flow thererough;

said lower cap portion having a circular extension extending inwardly from an inner wall, and a seal member disposed on said circular extension;

wherein said lower cap portion seal member contacts a lower surface of a bottom wall of the upper cap portion and creates a seal therebetween;

a valve member having a sealing portion and being dimensioned and configured to cover said lower cap portion opening;

said valve member threadably engaging said upper cap portion;

an anti-rotation means disposed on said lower cap portion and housing said valve member;

wherein rotation of said upper cap portion slides said valve member within said anti-rotation means to close off said opening of said lower cap portion in a first position, and slides said valve member away from said opening of said lower cap portion in a second position, allowing fluid contents from said container to flow through said opening of said lower cap portion and through said upper cap portion.

2. The carbonated drink closure and dispensing device of claim 1, wherein the bottom wall of the upper cap portion comprises a plurality of apertures for allowing fluid contents to flow therethrough and allowing the user to drink the contents by holding the container in any orientation.

3. The carbonated drink closure and dispensing device of claim 1, wherein said upper cap portion includes a central cylindrical post having a threaded bore therethrough for operably engaging the valve member.

4. The carbonated drink closure and dispensing device of claim 3, wherein said lower cap portion includes an annular recess created by an outer wall, the inner wall, and a top wall, wherein an upper portion of the container is received within the annular recess.

5. The carbonated drink closure and dispensing device of claim 4, further comprising an O-ring resilient seal disposed between a lower surface of the top wall of the lower cap portion and an upper peripheral surface of a rim of the container.

6. The carbonated drink closure and dispensing device of claim 1, wherein the valve member includes a convex sealing portion, and a threaded screw portion extending upwardly from a central portion of the convex sealing portion.

7. The carbonated drink closure and dispensing device of claim 6, wherein the threaded screw portion of said valve member threadably engages a threaded bore of said upper cap portion.

8. The carbonated drink closure and dispensing device of claim 6, wherein the anti-rotation means is a plurality of portions having a channel-type recess on the inner wall of the lower cap portion, and wherein each channel-type recess is dimensioned and configured to engage a corner of the convex sealing portion of the valve member.

9. The carbonated drink closure and dispensing device of claim 1, wherein said sealing surface of said valve member sealingly engages a lower surface of said lower cap portion seal member in the first position of the valve member.

10. A carbonated drink closure and dispensing device, comprising:

an upper cap portion;

a lower cap portion removably and rotatably secured to said upper cap portion at one end, and removably secured to a top opening of a container at an opposing end;

said lower cap portion having an opening allowing fluid contents of the said container to flow thererough;

said lower cap portion having a circular extension extending inwardly from an inner wall, and a seal member disposed on said circular extension;

wherein said lower cap portion seal member contacts a lower surface of a bottom wall of the upper cap portion and creates a seal therebetween;

a valve member having a sealing portion and being dimensioned and configured to cover said lower cap portion opening;

said valve member threadably engaging said upper cap portion;

an anti-rotation means disposed on said lower cap portion and housing said valve member;

wherein rotation of said upper cap portion slides said valve member within said anti-rotation means to close off said opening of said lower cap portion in a first position, and slides said valve member away from said opening of said lower cap portion in a second position, allowing fluid contents from said container to flow through said opening of said lower cap portion and through said upper cap portion.

* * * * *